United States Patent [19]

Amorese et al.

[11] 4,365,897

[45] Dec. 28, 1982

[54] SEPARABLE BLADE AGITATOR WITH CLIP-ON IMPELLERS

[76] Inventors: Franklyn J. Amorese, 39 Peck Rd., Greece, N.Y. 14468; Vincent J. Piarulli, 86 Cherry Creek La., Greece, N.Y. 14626

[21] Appl. No.: 265,526

[22] Filed: May 20, 1981

Related U.S. Application Data

[63] Continuation of Ser. No. 52,809, Jun. 28, 1979, abandoned.

[51] Int. Cl.[3] ..... B01F 13/00

[52] U.S. Cl. ..... 366/343; 366/349; 416/214 R; 416/241 R

[58] Field of Search ..... 366/342–344, 366/308, 325, 326, 331, 349, 605, 129, 279, 285, 286, 330; 416/200 R, 214 R, 241 R, 244 R, 175, 203

[56] References Cited

U.S. PATENT DOCUMENTS 2,811,339 10/1957 Osborne et al. ..... 416/214

*Primary Examiner*—Philip R. Coe
*Assistant Examiner*—Timothy F. Simone

[57] ABSTRACT

A separable blade agitator having the impeller blades joined to the drive shaft in an interference fit effected by a hub on one of the separable impellers which embraces both the shaft and the other impeller.

6 Claims, 4 Drawing Figures

SEPARABLE BLADE AGITATOR WITH CLIP-ON IMPELLERS

This application is a continuation of application Ser. No. 052,809, filed June 28, 1979 now abandoned.

BACKGROUND OF THE INVENTION

The present invention relates generally to separable blade agitators and more particularly to a glass coated agitator and the apparatus and method for assembling the agitator within a mixing vessel.

Separable blade agitators are well known in the art and are described for example in U.S. Pat. Nos. 2,811,339 and 3,494,708. Briefly, a separable blade agitator includes a drive shaft and a separable impeller. The impeller includes a hub for attachment to the drive shaft and two or more blades extending outwardly from the hub. The entire surface of the drive shaft, hub and blades exposed to the contents of the vessel is glass coated to resist corrosion, adherence and abrasion. Such separable blade agitators are used in vessels for mixing various corrosive, adhesive, abrasive or easily contaminated ingredients such as acids, polymers, pharmaceuticals, dyes and the like.

These agitators especially have great value in closed vessels because they eliminate the need for large vessel openings normally used for agitator removal and admittance. In this respect, the separable impeller portions can be passed into a pressure vessel through a relatively small manhole opening and assembled within the vessel to the drive shaft.

Separable blade agitators are useful in either closed or open vessels in that they permit replacement of damaged impellers or changing the size or type of impeller without the need to remove the entire agitator (i.e. drive shaft and impeller) from the vessel or to disconnect the drive shaft from the drive motor and seals.

Separable blade agitators having gaskets between the shaft and impeller are known. Such agitators are not entirely satisfactory because any gasket used must be made from tantalum or other exotic metal or from a fluro-carbon in order to resist the highly corrosive environments to which these gaskets may be exposed. Another drawback with gaskets is that they take a set due to repeated heating and cooling and eventually leak. Normally, leaking gaskets can be resealed by tightening, but this is difficult to do in separable blade agitators and often a leak is not noticed until leakage into the shaft has caused damage.

Separable blade agitators are also known in which no gaskets are used, as shown for example in U.S. Pat. No. 3,494,708. Here a gasketless connection is made by forcing near optically flat glass coated surfaces together with considerable force. The primary drawback of the construction shown in this prior art is that relatively complicated, expensive components, which themselves are not glass coated, are needed to hold the shaft and agitator portion together in a fluid tight gasketless connection capable of transmitting torque from the drive shaft to the impeller blades.

Thus, prior art separable blade agitators used gaskets or optically flat surfaces between joints to seal the joints between the separable members and isolate non-corrosive resistant surfaces from the vessel contents. The present invention, however, does not rely on sealed joints because all surfaces exposed to the vessel contents are protected by non-corrosive coatings such as glass or plastic.

In the present invention, the configuration of both the drive shaft and separable impellers is such that they can be quickly and easily joined in an interference fitted, gasketless connection. The invention not only provides a safe connection because all exposed surfaces are glass coated, but also provides for relatively high torque transmission because of the cross sectional configuration of the hub of the impeller and a port on of the shaft to which the hub is attached.

SUMMARY OF THE INVENTION

In the present invention, the agitator shaft is flattened along a portion of its length to form two generally parallel sides for receiving the separable impellers. There are at least two separable impellers. The first impeller includes a flat sided mounting member disposed in facing relationship with one of the flat shaft sides and at least one blade extending radially from the mounting member. Shims are positioned between the mounting member and the shaft and a mechanical clamp applied across the blade and shaft to bow the mounting member toward the shaft thereby decreasing the space therebetween. A second impeller has a hub with a generally square opening and at least one blade extending radially from the hub. The hub is then slipped over the shaft and the mounting member of the first impeller so that upon release of the clamping force from the first impeller, the mounting member will spring outward against the clamping hub to lock the first and second impellers firmly to the shaft.

DESCRIPTION OF THE PREFERRED EMBODIMENTS

Figure 1:
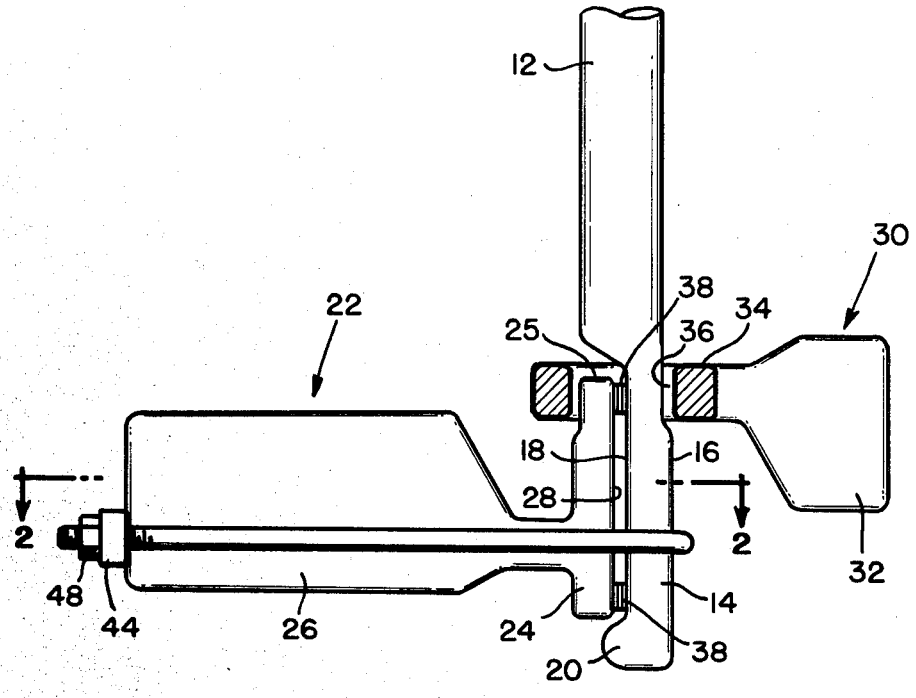
FIG. 1 is a side elevation view partly broken away and in section showing the components of the separable blade agitator prior to connection.

Referring to the drawing, FIG. 1 shows the lower portion of a vertically oriented agitator drive shaft 12. It should be appreciated that shaft 12 when in use, is suspended within a mixing vessel and that the upper end (not shown) of the shaft is attached by any suitable means to a motor and gear system for rotating the agitator shaft to mix the contents of the vessel.

It is not uncommon for agitators of this type to have a span equal to 40–60% of the of the vessel diameter. Consequently, a relatively large vessel opening would be required in order to allow the assembled agitator to pass into the vessel.

In order to avoid large vessel openings separable blade agitators are used so that the impeller blades can be carried separately through a small vessel opening into the vessel and then assembled to the agitator drive shaft within the vessel. Typical of those separable blade agitators known in the art are as described in the two U.S. patents set out hereinabove.

Referring again to FIG. 1, shaft 12 is round in cross section for the major portion of its length. However, the lower portion 14 is flattened to provide two generally flat parallel faces 16 and 18 and a generally rectangular cross section wherein the distance between the two faces 16 and 18 is less than the diameter of shaft 12.

The lower most end of the shaft is provided with a stop 20 adjacent face 18. Face 18, between stop 20 and the normal diameter of shaft 12, defines a mounting surface for one of the impellers as set out hereinbelow.

It should be appreciated that the entire outer surface of shaft 12 exposed to the contents of the mixing vessel is glass coated. For this purpose, it is important that all of the edges of shaft portion 14 be slightly rounded to accommodate a glass coating.

A first impeller for attachment to the shaft is identified at 22. This first impeller 22 includes an axially extending mounting foot 24 and an agitator blade 26 attached to and extending radially from the mounting foot. Mounting foot 24 is generally rectangular in cross section (FIG. 2) with a relatively flat surface 28 that can be disposed in face-to-face relationship with the mounting surface on the shaft provided by face 18. The upper end of the mounting foot has a reduced thickness so as to form a toe 25 for purposes set out hereinbelow.

It should be appreciated that the length of foot 24 is such that it can easily fit against face 18 between stop 20 and the normal diameter of shaft 12. All of the edges of impeller 22 are, of course, rounded so that its entire surface can be provided with a glass coating.

Figure 4:
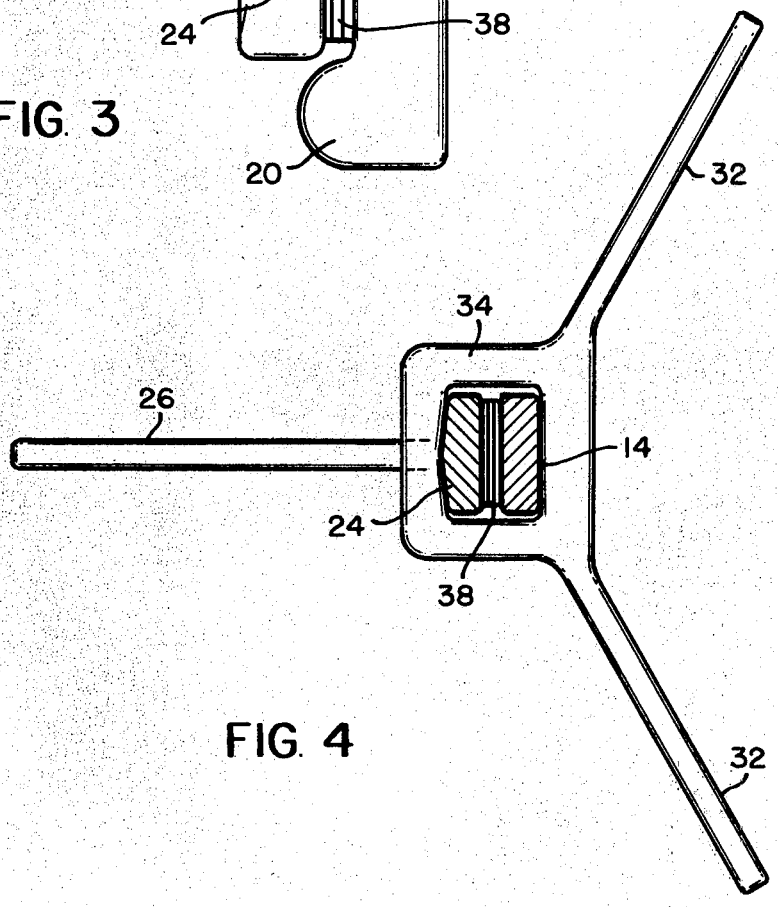
FIG. 4 is a view taken along lines 4—4 of FIG. 3.

A second impeller for attachment to the shaft is identified at 30. Second impeller 30 has one or more impeller blades 32 (see FIG. 4) extending radially outward from a central hub 34. Extending axially through the hub is a generally square opening or bore 36. The size and shape of opening 36 is sufficient to accommodate the lower portion 14 of shaft 12 and the mounting foot 24 of first impeller 22 for purposes of clamping the shaft and impellers 22, 30 together in a manner set out hereinbelow.

Completing the structure of the separable blade agitator as shown in FIG. 1 are shims 38 positioned between shaft mounting surface 18 and the flat surface 28 of first impeller 22. These shims preferably are made of a high corrosion resistant material such as tantalum or the like.

The shims are used to avoid the need to maintain close tolerances between the mating parts for an interference fit assembly (as described below) and reduces the cost of manufacture. However, in applications where exposure to any metal cannot be tolerated (i.e., where shims 38 cannot be used), the surfaces that control the dimension across foot 24 and shaft portion 14 and the inside dimension of bore 36 can be ground to provide the close tolerances needed for an interference fit assembly. In such a case surface 28 of mounting foot 24 would be under cut so as to provide the mounting foot with thicker ends as is now provided by shims 38. The term "spacer means" in the claims in intended to include such thicker ends of the foot 24.

Figure 2:
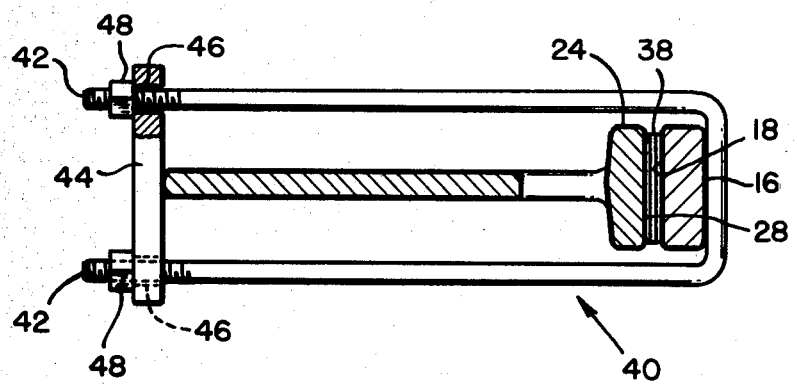
FIG. 2 is a view taken along lines 2—2 of FIG. 1.

Referring now to FIGS. 1 and 2, a special tool 40 is shown for use in assembling the two separable impellers 22 and 30 to the agitator shaft 12. Tool 40 is in the shape of a elongated U. The ends 42 of each of the elongated legs of the U-shape are threaded. A cross bar 44 extends across the elongated legs of the tool and has openings 46, to permit the free movement of the legs through the cross piece. Completing the structure of the U-shaped tool are nuts 48 threaded to the ends 42 of each leg.

The assembly of the first and second impellers 22, 30 to agitator shaft 12 is accomplished in the following manner. Second impeller 30 is moved onto the shaft first by lifting the impeller above the position shown in FIG. 1 so as to allow shaft portion 14 to pass through the bore opening 36. The second impeller 30 then is temporarily supported in the elevated position manually or with a suitable mechanical means not shown.

The first impeller 22 is then lifted into position with its flat surface 28 resting against the mounting surface of face 18. Second impeller 30 is then dropped over the toe 25 of mounting foot 24 as shown in FIG. 1. The thickness of foot 24 and shaft portion 14 are together, smaller than the dimension across hub opening 36 so that if the second impeller 30 were released, it would merely slide down on to foot 24 and shaft portion 14 and would not clamp foot 24 to the shaft.

In order to provide a clamping action, second impeller 30 is held in the position shown in FIG. 1 while shims 38 are positioned between shaft portion 14 and foot 26. The thickness of the shims can be selected and adjusted to increase the spacing between foot 24 and shaft portion 14 so that the dimension across these components is greater than the inside dimension of hub opening 36. With the arrangement as described, the second impeller part 30 now will not be able to slide down over the foot and shaft portion to effect a clamping relationship and instead, will simply be held in the position shown in FIG. 1.

Figure 3:
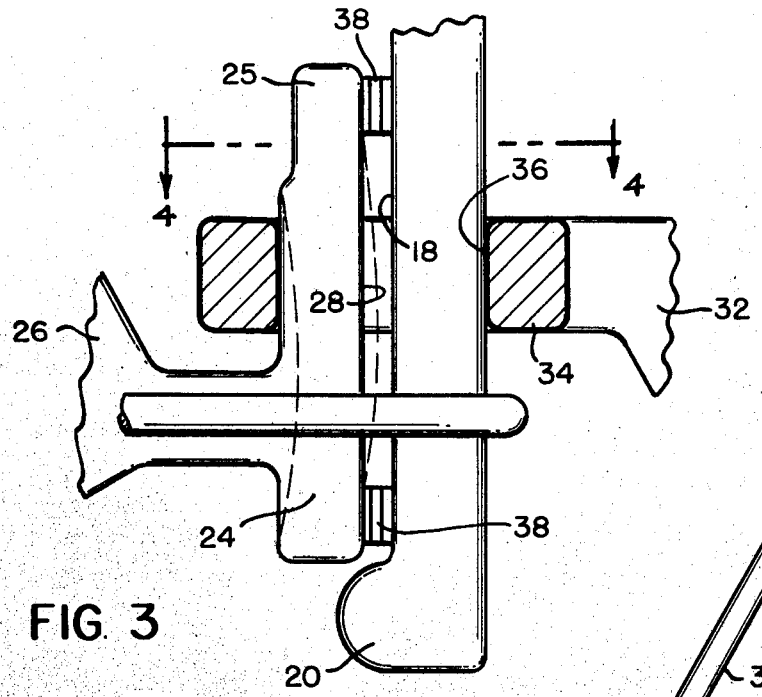
FIG. 3 is a view on an enlarged scale of the agitator components in an assembled condition.

After shims 38 have been put in position, tool 40 is put into the position as shown in FIGS. 1 and 2 and nuts 48 are tightened. This drives cross piece 44 to the right as shown in the figures. As nuts 48 are turned still further, the force exerted by the tool causes mounting foot 24 to bow inwards towards face 18 as shown in dotted line in FIG. 3. This decreases the space between the shaft and the mounting foot and reduces the dimension across the foot and shaft portion 14 to a distance which is less than the width of hub opening 36. Hub 34 can now slide down over the mounting foot 24 to the position shown in FIG. 3.

As nuts 48 are now loosened so that tool 40 can be removed, mounting foot 24 springs outward against hub 34. This draws the hub, mounting foot and shaft portion together and locks the entire assembly together in a rigid connection. The contact pressures between hub 34, foot 24 and shaft portion 14 are sufficient to prevent movement of the components when subjected to the forces applied to the impeller blades 26, 32 during a mixing operation. Moreover, the connection provided by the present invention is effected without the use of any permanent mechanical fasteners such as screws, bolts or the like which can become loosened or damaged during use.

Thus, the present invention provides a means of furnishing a streamlined separable blade mixing agitator that can be installed through small vessel openings such as a manhole. The design allows a variety of spans and blade configurations to be applied without restrictions and provides mechanical stability without the need for any fasteners that could come loose.

While a three blade design has been described with one blade on the first impeller and two blades on the second, other blade combinations can be used. For example, a hub, without agitator blades could be used to fix one or more impellers to the shaft. Thus, the present invention allows considerable flexibility for changing the number, size and shape of agitator blades without the need to change or disturb the main drive shaft 12.

All surfaces of the impellers and shaft are provided with a corrosion resistant glass coating and although the design is primarily to be used in applications requiring such a coating, the design can also be applied to agitators with other coatings such as plastic, rubber, etc. where coating conventional fasteners is not practical. Accordingly, the design of the present invention is well suited to applications where agitators, made from any materials of construction, must be installed through small openings and where the use of conventional mechanical fasteners could be a disadvantage.

While all the mounting and clamping surfaces are shown to be flat, it should be appreciated that they also could be concave, convex or some other convenient shape capable of receiving a glass coating. The important thing is that the surface 28 be complementary to surface 18 and that the inside profile of bore 36 match the profile formed by the mounting foot 24 and shaft portion 14 together.

It should be readily apparent that from a design standpoint, the length and thickness of mounting foot 24 should be such that the desired amount of flexure can be obtained with tool 40 without exceeding the compression factor of the glass coating. Such design criteria would be within the skill of the art. Also, while a particular tool 40 has been described for effecting the interference fit it should be obvious that any suitable mechanical or hydraulic means can be used which is able to exert sufficient force across foot 24 to deform it towards shaft surface 18.

Having thus described the invention in detail, what is claimed as new is:

1. A separable blade agitator comprising:

(a) a glass coated shaft terminating as an axially extending mounting shaft, (b) a first glass coated impeller mounted to said mounting shaft and including an axially extending mounting base portion corresponding with said axially extending mounting shaft, (c) a second glass coated impeller mounted to said mounting shaft and including a hub defining an axial bore embracing said mounting shaft and said mounting base portion of said first impeller, and (d) spacer means disposed between said mounting shaft and the ends of said mounting base portion of said first impeller to space said mounting shaft and said mounting base portion apart by an amount to effect an interference fit of said hub over said mounting shaft and said mounting base portion, whereby said hub compresses said mounting base portion and said mounting shaft toward each other, between said spacer means, to rigidly clamp said shaft and said first and second impellers together.

2. A separable blade agitator as in claim 1 wherein the corresponding faces of said mounting shaft and said mounting base portion are generally flat.

3. A separable blade agitator as in claim 1 wherein said shaft is generally round in cross section over a major portion of its length and said mounting shaft is rectangular in cross section.

4. A separable blade agitator as in claim 1 or 3 wherein the cross section of said mounting shaft together with the cross section of said mounting base portion forms generally a square cross section.

5. A separable blade agitator as in claim 1 wherein said spacer means are tantalum shims.

6. A separable blade agitator comprising:

(a) an agitator shaft having a relatively flat, axially extending mounting surface adjacent one end;

(b) a first impeller including (i) an elongated axial mounting member, one side of said mounting member having a relatively flat surface disposed in face-to-face relationship with said mounting surface on said shaft, and (ii) an agitator blade extending radially from said mounting member;

(c) a second impeller including a hub and an agitator blade extending radially from said hub;

(d) said hub having a bore for receiving therethrough said mounting member and shaft end so that said hub embraces said mounting member and shaft;

(e) shim means located adjacent the ends of said elongated mounting member and between said mounting surfaces for increasing the spacing therebetween by an amount sufficient to produce an interference fit between said hub, shaft and mounting member, said interference fit causing said hub to exert a radially acting embracing force on said shaft and mounting member, between said shim means, to rigidly clamp the same together.

* * * * *